US005273467A

United States Patent [19]

Hall

[11] Patent Number: 5,273,467

[45] Date of Patent: Dec. 28, 1993

[54] EXHAUST DISCHARGE FOR A PUMP JET

[75] Inventor: Kimball P. Hall, LaPlata, Md.

[73] Assignee: Hall Marine Corporation, LaPlata, Md.

[21] Appl. No.: 852,535

[22] Filed: Mar. 17, 1992

[51] Int. Cl.[5] ..... B63H 21/32

[52] U.S. Cl. ..... 440/89; 440/900

[58] Field of Search ..... 440/900, 38, 89, 47; 60/221, 310, 222

[56] References Cited

U.S. PATENT DOCUMENTS

| | | | |
|---|---|---|---|
| 3,249,083 | 5/1966 | Irgens | 440/38 |
| 3,849,982 | 11/1974 | Hall | 440/38 |
| 3,943,876 | 3/1976 | Kiekhaefer | 440/89 |
| 4,023,353 | 5/1977 | Hall | 440/38 |
| 4,600,394 | 7/1986 | Dritz | 440/89 |
| 5,145,428 | 9/1992 | Harrison | 440/89 |

*Primary Examiner*—Edwin L. Swinehart

*Attorney, Agent, or Firm*—Mathews, Woodbridge & Collins

[57] ABSTRACT

A marine pump jet apparatus is described which is attached to the lower unit of a conventional outboard motor. The pump jet, which replaces the usual propeller element, consists of an axial flow pump containing a bladed impeller and stator vanes enclosed in a housing. In conventional outboards, exhaust gas flows downward from the power head through a duct in the motor and rearward through ducts in the motor gear case and the propeller hub to be discharged under water. In the present apparatus, before the exhaust reaches the gearcase, it is directed into a diversion passage which causes it to exit (still under water) above the upper surface of the pump jet. A trough is provided in the upper surface of the pump jet housing. The diversion passage directs a portion of the exhaust stream into the trough, thereby reducing drag on the motor.

9 Claims, 7 Drawing Sheets

FIG. 7
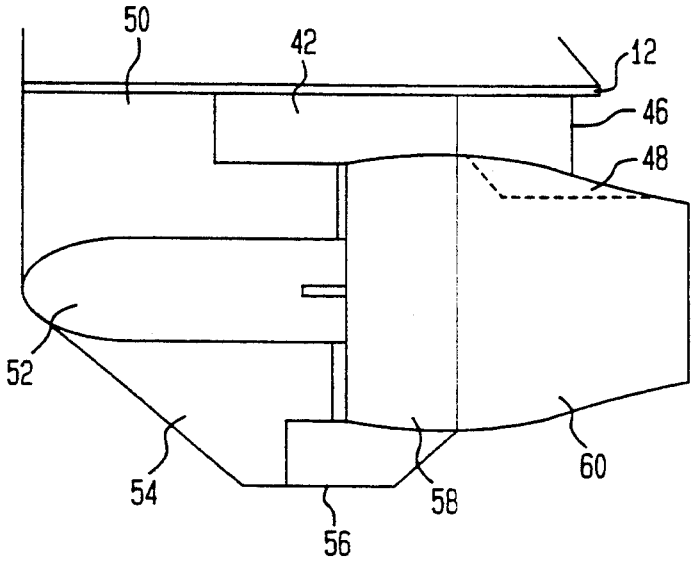
FIG. 8
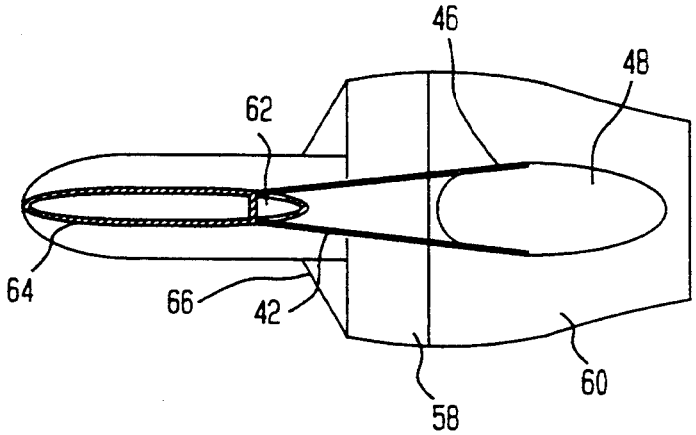
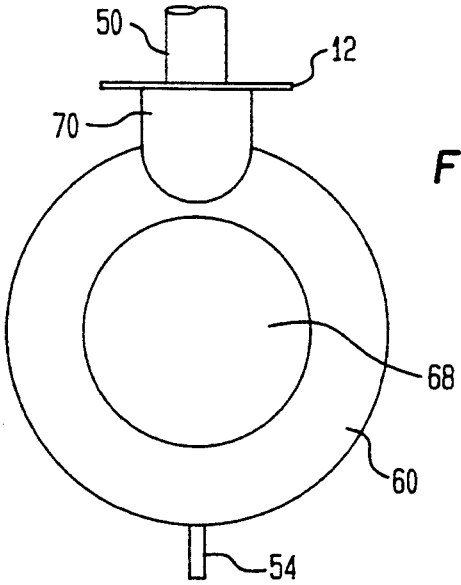
FIG. 9

EXHAUST DISCHARGE FOR A PUMP JET

BACKGROUND OF THE INVENTION

Field of the Invention

This invention relates to an apparatus for directing the discharge of exhaust gases from an outboard motor having an attached pump jet.

Description of the Related Art

In conventional outboard motors, a propeller is driven by a powerhead to propel a boat through the water. Essentially all modern motors inject the exhaust gas stream under water in order to reduce noise of the engine. However, the injected stream of exhaust gas can occupy a space, causing drag.

Prior to the 1970s most outboards injected the exhaust gas as shown in FIG. 1. In this motor, exhaust is directed from a powerhead 34 through downstream channel 11 to exhaust gas outlet 14. The exhaust is injected from gas outlet 14 into the water behind propeller 13. This type of motor will be referred to as a downstream exhaust motor.

During the 1970s, many outboards changed over to the configuration shown in FIG. 2, this type of motor will be referred to as an exhaust through the hub motor. In this modification, exhaust flows from powerhead 34 through a hub exhaust channel 15. The exhaust exits the motor through modified propeller 17. Almost all motors of current manufacture are exhaust through the hub, including motors made by Evinrude, Johnson, Mercury, Yamaha, Suzuki and others. (The only manufacturer that continues building downstream exhaust motors in quantity is Force.)

The reason for the change over to an exhaust through the hub motor was the drag caused by the exhaust. It is known that the gear case causes drag. By locating the exhaust stream concentrically behind the gear case, the drag of the exhaust can be canceled out by the drag of the gear case.

U.S. Pat. No. 3,249,083 describes an outboard motor having a propeller positioned behind a gear case in which exhaust which originates in the outboard powerhead, is ducted downward through the central body of the motor, and is discharged underwater behind the gear case. A passageway is formed in the hub of the outboard propeller for channelling the exhaust gas downstream. This system is an exhaust through the hub system.

Manufacturers received an added benefit when the exhaust through the hub configuration was used. They were able to increase efficiency by using a larger diameter gear case, larger crown gears, and thus slower-turning, more efficient propellers without increasing drag. Examples of this type of outboard motor are Evinrude's 70-hp motors, or Johnson's 35-hp motors.

It is possible to replace the propeller on either the downstream exhaust motor or the exhaust through the hub motor with a shrouded impeller or pump jet system, in which the impeller is mounted directly on the propeller shaft instead of the propeller. Such a system has the advantages of reducing hazards to swimmers in the vicinity of the motor, protecting the rotor elements from interference and damage by foreign objects and improving the efficiency and performance of the propulsion system.

An example of this kind of pump jet installed on downstream exhaust motor is shown in FIG. 3.

This pump jet was designed by the same inventor as the 10 inventor of this application. FIG. 3 illustrates a bladed rotary impeller 18 being positioned below an anticavitation plate 12 and rearward of a lower unit housing 10. The bladed rotary impeller 18 is attached to a rearwardly projecting propeller shaft 16 for rotation therewith. A shroud 21 having a front section 20 and a rear section 22 houses the bladed rotary impeller 18. A bearing support 26 engages the rear end of the propeller shaft 16. The vanes 30, which are present to neutralize the swirl from the impeller, also serve to attach the bearing support 26 to the rear shroud section 22. At the rear end of the anticavitation plate 12 is a downwardly projecting exhaust gas outlet 14 which projects the exhaust gas into a channel 24 formed in the upper surface of the rear section 22. U.S. Pat. No. 3,849,982 further describes the outboard motor including a pump jet system as shown in FIG. 3. Since the exhaust stream does not flow through the central portion of the propeller, this system is not an exhaust through the hub system.

U.S. Pat. No. 4,023,353 describes a pump jet mounted on an exhaust through the hub outboard motor. This system was designed by the same inventor as the inventor of this application. The system discharges engine exhaust gas from the powerhead to a rotor. A circular duct positioned below the outer surface of the hub of the rotor receives the exhaust gas. Exhaust gases are discharged rearwardly through the rotor hub during forward drive and are radially discharged outwardly at a discharge location forward of the pump jet housing during reverse drive. This complex exhaust system design results in high manufacturing costs.

SUMMARY OF THE INVENTION

Briefly described, the invention comprises an apparatus for directing the discharge of exhaust gases through the central portion of an outboard motor above an attached pump jet.

A marine outboard motor is fitted with a pump jet positioned below the motor at the rearend thereof. An exhaust duct is provided extending downwardly within the central portion of the outboard motor to receive exhaust gas generated by the powerhead. An exhaust channel is positioned rearwardly of the exhaust duct to permit the exhaust gas to exit the motor at a position above the pump jet. An extension duct is connected to the exhaust channel so that the gas is directed from the exhaust channel towards the rear end of the pump jet. A trough is formed in the upper surface of the pump jet shroud. A significant portion of the gas stream in the extension duct expands into the trough permitting the exhaust stream to be hidden behind the rotor and stator housings. The motor upon which this system is mounted is an exhaust through the hub motor. Thus, drag of the exhaust stream is partly or wholly canceled out by the drag of the stator and rotor housings. Such a modification in the flow direction of the outboard motor exhaust stream results in a decrease in the overall drag of the motor.

The invention may be more fully understood by reference to the following drawings.

BRIEF DESCRIPTION OF THE DRAWINGS

FIG. 7 is a side elevational view of the preferred embodiment of the invention.

FIG. 8 is a top plan view of the preferred embodiment of the invention.

FIG. 9 is a rear elevational view of the preferred embodiment of the invention.

DETAILED DESCRIPTION OF THE INVENTION

During the course of this description like numbers will be used to identify like elements according to the different figures which illustrate the invention.

Figure 1:
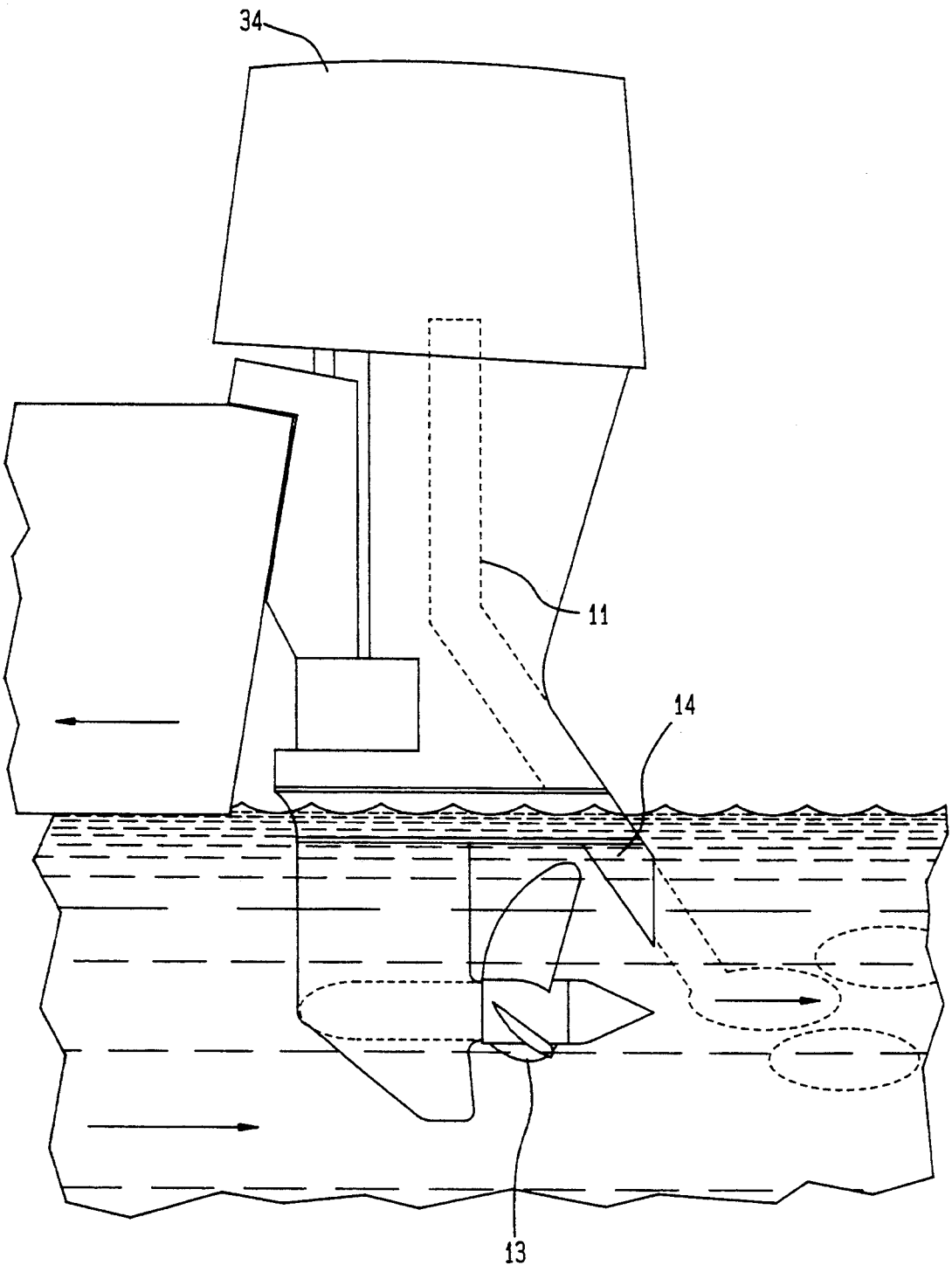
FIG. 1 (PRIOR ART)
FIG. 1 .is a schematic view of a prior art downstream exhaust motor with a propeller.
Figure 2:
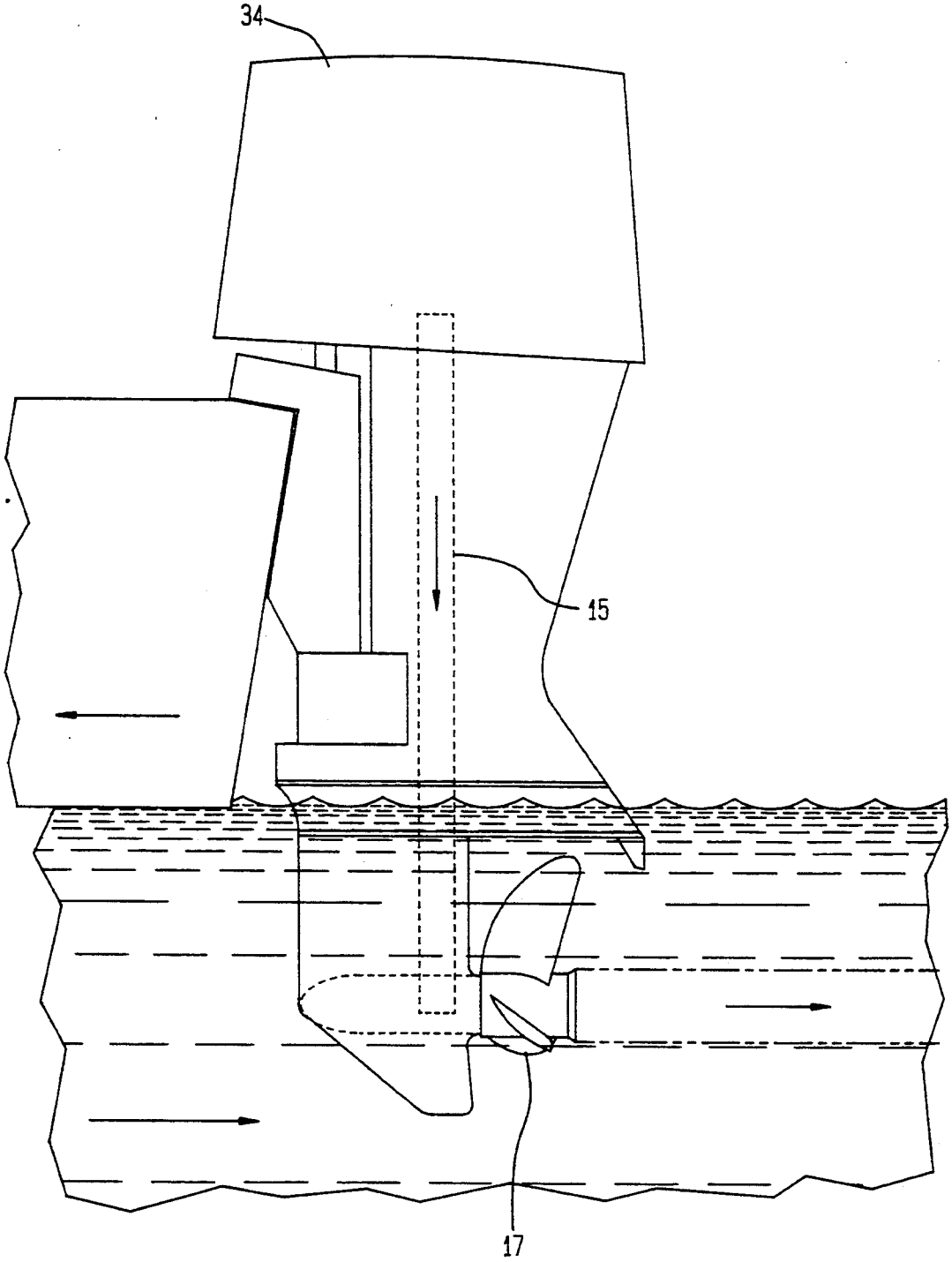
FIG. 2 (PRIOR ART)
FIG. 2 is a schematic view of a prior art exhaust through the hub motor with a propeller.
Figure 3:
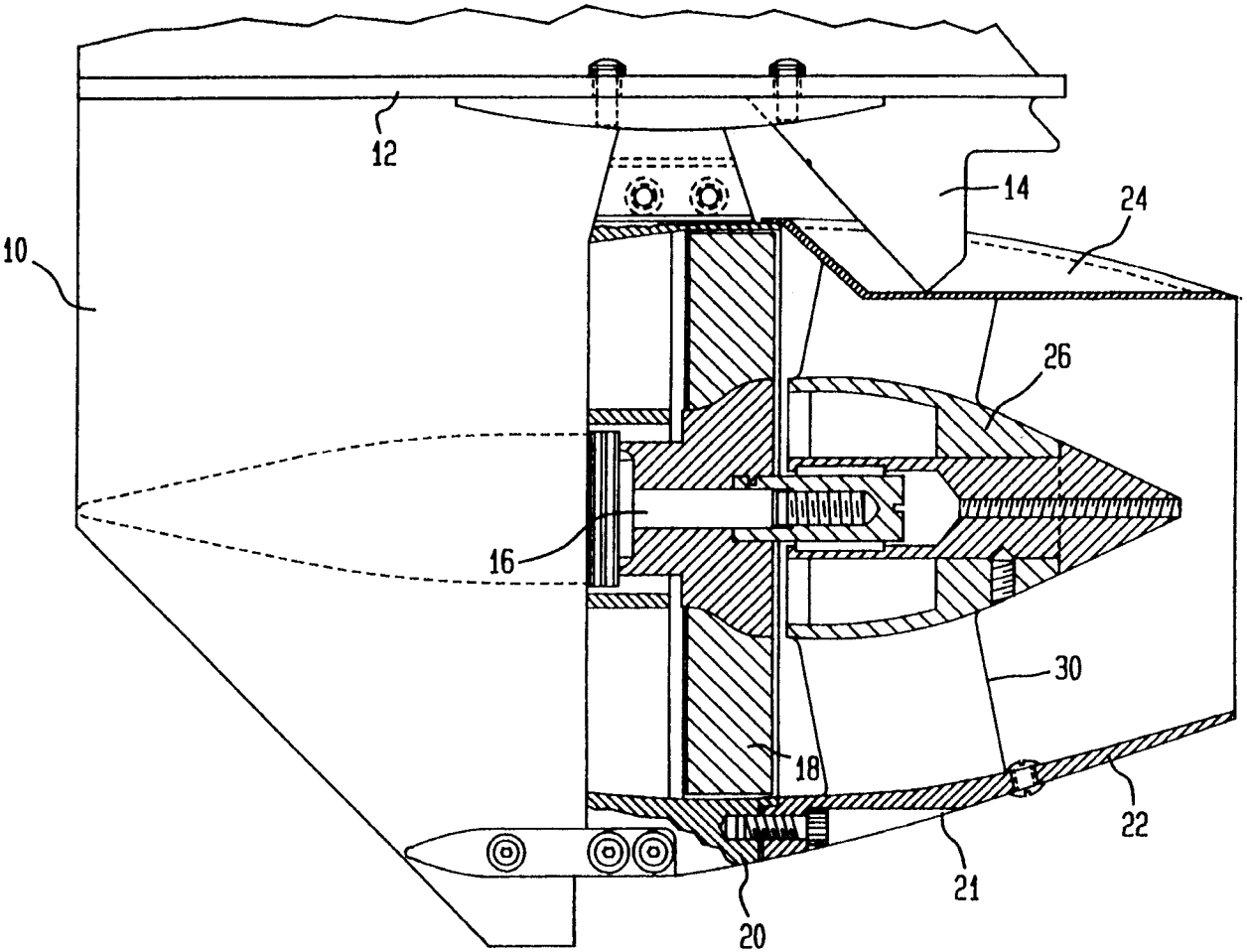
FIG. 3 (PRIOR ART)
FIG. 3 is a vertical cross-sectional view of a prior art downstream exhaust pump jet.
Figure 4:
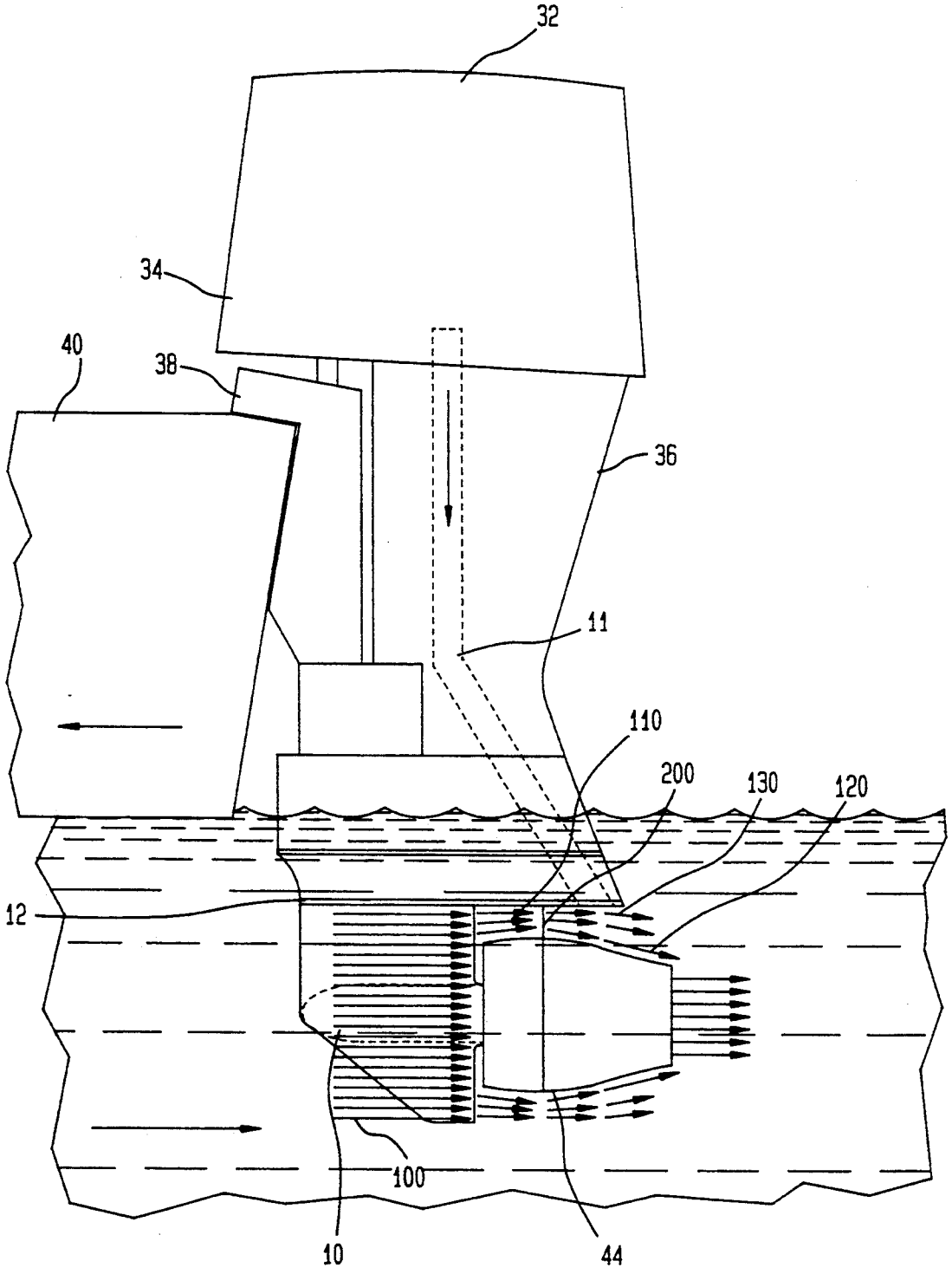
FIG. 4 (PRIOR ART)
FIG. 4 is a schematic view of a prior art downstream exhaust motor with a pump jet.
Figure 5:
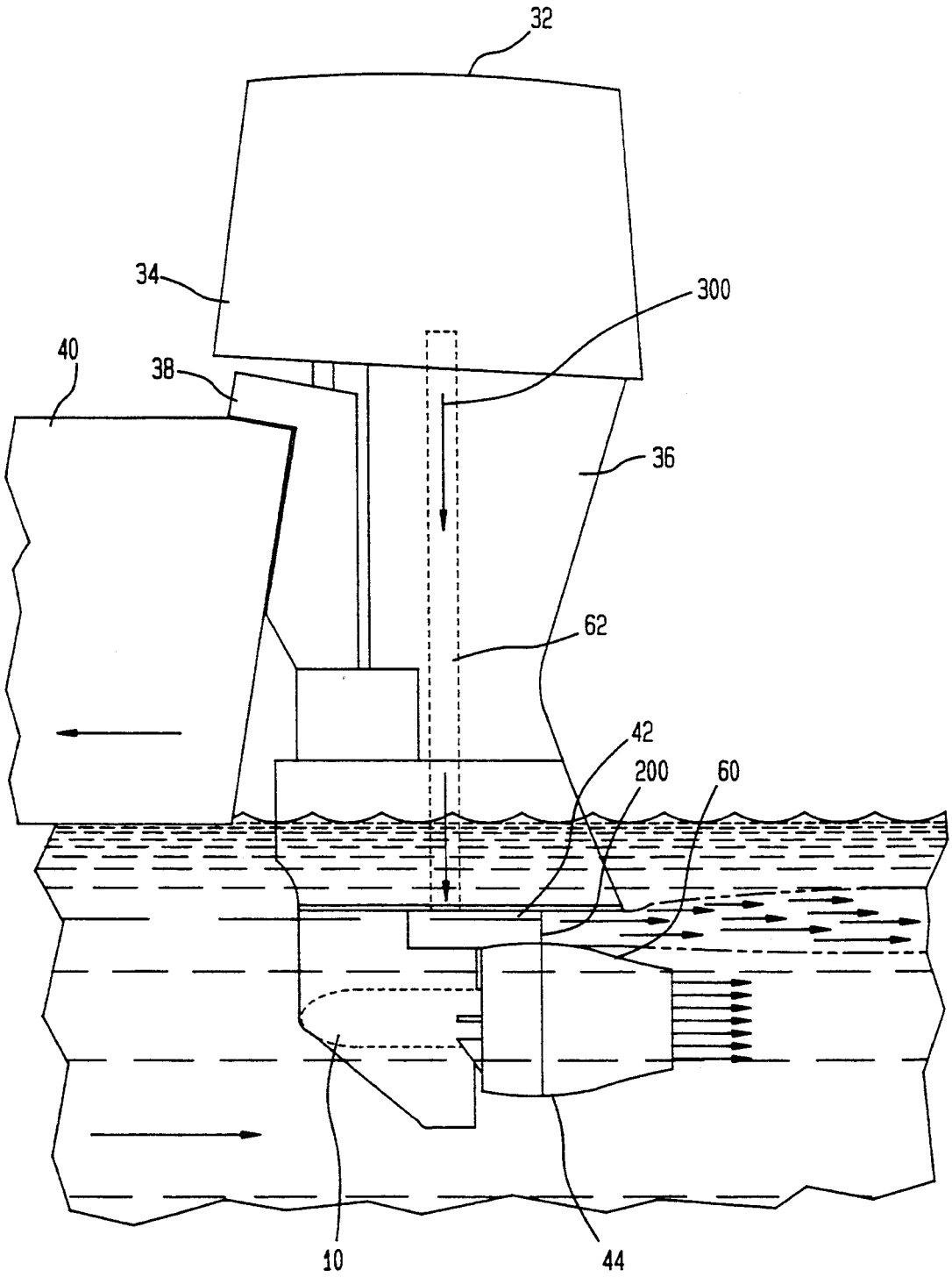
FIG. 5 is a schematic view of an embodiment of the invention having an exhaust stream discharged at the squeeze point.

In normal operation of a downstream exhaust motor having attached a pump jet as shown in FIG. 4, flow streamlines 100 follow the shape of the lower unit housing 10. Streamlines 110 behind the lower unit housing 10 follow the surface of the shroud front section 20 and rear section 22. At the maximum diameter of the pump jet between the top of the pump jet surface and the bottom surface of the anticavitation plate 12 is a "squeeze point" 200. Streamlines 120 downstream of the "squeeze point" 200 and near the surface of the pump jet try to follow the conical surface of the pump and streamlines 130 near the anticavitation plate 12 try to remain parallel to the anticavitation plate 12. During the operation of a downstream exhaust motor, outboard motor exhaust is not discharged through the central portion of the motor and is not discharged at the "squeeze point" 200. In a downstream exhaust motor, a portion of the water which surrounds the pump jet in the area forward of the "squeeze point" 200 flows into the constricted area between the anticavitation plate 12 and the top of the pump jet. The velocity of this water remains equal to but in the opposite direction from the speed of the boat. Downstream of the "squeeze point" 200, the area between the anticavitation plate 12 and the top of the pump jet increases. Since the volume of water which has flowed through the constricted area at the "squeeze point" 200 is insufficient to fill this enlarged downstream area, the larger area must be filled by diverting water from adjacent layers. As a result drag is created downstream of the "squeeze point" 200. FIG. 5 diagrammatically illustrates an embodiment of the basic concept of this invention. The same structures shown in FIG. 3 are designated by the same reference numerals. In FIG. 5 exhaust gas discharges at the "squeeze point" 200, filling the area formed between the upper surface of the pump jet 44 and the anticavitation plate 12. Since water no longer fills the area, drag from this source is eliminated.

A pump jet 44 is mounted on an outboard motor 32. The outboard motor 32 comprises a powerhead 34 and a leg 36. The outboard motor 32 includes a conventional anticavitation plate 12 and lower unit housing 10. The outboard motor 32 is preferably attached to a marine vehicle 40 by an appropriate mounting bracket 38. Examples of an acceptable outboard motor 32 are the 35/70 hp units manufactured by Outboard Marine Corporation or Johnson Motors. In an alternative embodiment an inboard motor could be substituted for the outboard motor 32.

During operation of the motor, an exhaust gas stream 300 flows downwardly from the powerhead through an exhaust duct 62 positioned in the central portion of the outboard motor. The exhaust gas is channelled in a rearward direction from the exhaust duct 62 to an exhaust channel 42. The exhaust gas flows from the exhaust channel 42 above the stator housing 60 to exit the outboard motor 32.

Figure 6:
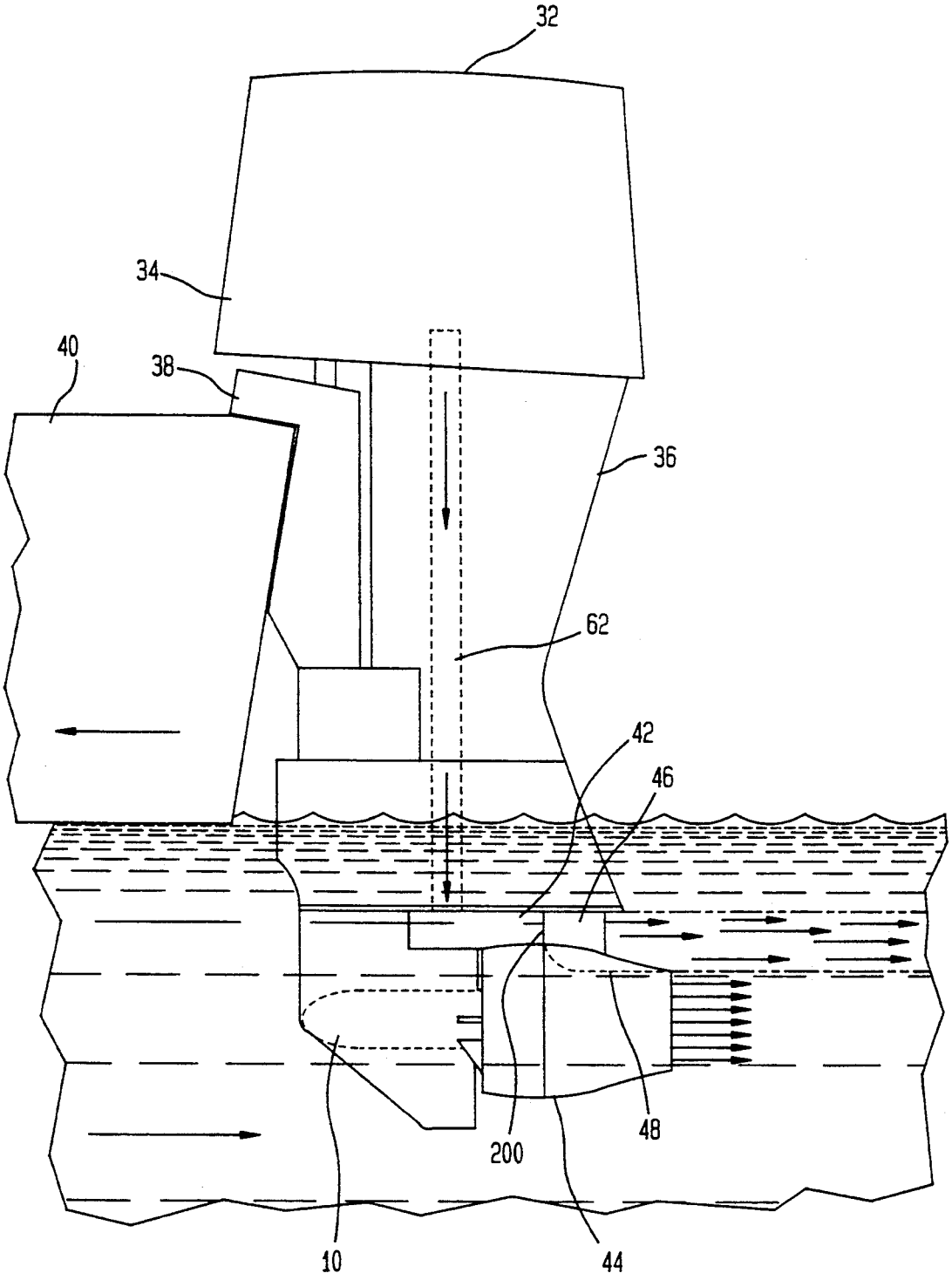
FIG. 6 is a schematic view of the preferred embodiment of the invention having an exhaust stream discharged rearward of the squeeze point.

FIG. 6 illustrates how the exhaust gas stream generated by the outboard motor 32 is discharged through the central portion of the motor at a position downstream of the "squeeze point" 200. An exhaust extension duct 46 is positioned above the stator housing 60 and is coupled to the exhaust channel 42 for discharging the exhaust gas rearwardly of the "squeeze point" 200. The rear end of the exhaust extension duct 46 flares outwardly for controlling the size of the exhaust gas stream. The angle of the flare of the exhaust extension duct 46 can be increased or decreased to control the expansion of the exhaust gas stream. A trough 48 is formed in the upper surface of the stator housing 60 below the exhaust extension duct 46 to receive the exhaust gas. The trough 48 allows a portion of the exhaust stream to be concealed behind the pump jet housing whereby an improved flow of the exhaust gas stream is achieved and drag is reduced.

FIG. 7 is a side elevational view of the lower portion of the outboard motor with mounted pump jet 44. A lower unit housing 10 encloses a strut 50, gear case 52 and skeg 54. A rotor housing 58 and a stator housing 60 form the housing for the pump jet 44. The rotor housing 58 and the stator housing 60 correspond respectively to the shroud front section 20 and the rear section 22 shown in FIG. 3. The rotor housing 58 and stator housing 60 can be attached to the lower unit of a motor in the manner described in U.S. Pat. No. 3,849,982. The point at which the stator housing 60 is attached to the rotor housing 58 is the point of the largest diameter of pump jet 44. The point of the largest diameter forms the "squeeze point" 200. It will be appreciated that the shape and position of the largest diameter of the pump jet 44 can be varied.

The bottom of the rotor housing 58 is preferably welded to skeg 54 by a welded gusset plate 56. The exhaust duct 42 is preferably formed by welding two pieces of sheet metal aluminum to the sides of strut 50 to the undersurface of the anticavitation plate 12 and to the top of rotor housing 58. In the alternative, the exhaust duct 42 can be formed of a rectangular metal or plastic 10 tube and can be screwed in place.

FIG. 8 is a top plan view of the lower portion of the outboard motor with mounted pump jet 44 in which two welded delta struts 66 attach the rotor housing 58 to gear case 52. In an alternate embodiment four delta struts 66 are positioned at 45° from the horizontal for attaching the rotor housing 58 to gear case 52. It will be appreciated that different methods for attaching a rotor housing to a gear case are known in the art. The exhaust extension duct 46 is preferably positioned at the forward portion of the stator housing above the trough 48. The exhaust extension duct 46 is preferably formed of heavy gauge sheet metal. Alternatively, the exhaust extension duct 46 can be formed by an aluminum die or sand casting, or can be a plastic injection-molded part. It will be appreciated that different materials for forming duct portions are known in the art.

The exhaust extension duct 46 can be attached to the anticavitation plate 12 and to the exhaust duct 42 with conventional machine screws. In the alternative, the forward ends of the exhaust duct extension 46 can be fitted into slots in the exhaust duct 42. In an alternative embodiment, the exhaust extension duct 46 can be formed as an integral part of the stator housing 60. It will be appreciated that the contact between the exhaust extension duct 46 and the trough 48 allows for flow of the exhaust gas stream, but it need not be leak-tight. Further, the lower unit housing 10, rotor housing 58, exhaust duct 42 and delta struts 66 can be formed by single integrated casting. In the alternative, the lower unit housing 10, rotor housing 58, exhaust duct 42 and delta struts 66 can be formed by vacuum casting or sand casting.

FIG. 9 is a rear elevational view of the lower portion of the outboard motor in which exhaust exits the trough 48 in an area 70. FIG. 9 illustrates the area 70 positioned above jet stream 68. The exhaust exiting the area 70 does not interfere with the force of the jet stream 68. This position of the trough 48 allows the drag of a substantial portion of the exhaust stream to be canceled out by the drag of the rotor housing 58 and stator housing 60.

An engineering estimate was made of the cross sectional area of the exhaust stream for a 35-hp outboard motor. The calculation is dependent on the volume flow rate of exhaust gas and the speed of the boat. The results are shown in Table I.

TABLE I

Cross-Sectional Area of Exhaust Gas Flow From an Outboard Motor

| | |
|---|---|
| motor displacement | 31.6 cu. in |
| RPM of motor at wide open throttle | 5,500 RPM |
| rate of ingestion of air | 173,800 cu. in./min |
| rate of ingestion of air | 1.68 cu. ft./sec |
| approx. inlet temperature | 298° K. |
| approx. outlet temperature | 373° K. |
| flow rate of gas emitted | 2.10 cu. ft./sec. |
| Calculation for Boat Travelling at 30 mph | |
| speed of boat in ft/sec. | 43.9 ft./sec. |
| cross sect. area of exhaust | 0.048 sq. ft. |
| cross sect. area of exhaust | 6.88 sq. in. |
| Calculation for Boat Travelling at 18 mph | |
| speed of boat in ft/sec. | 26.4 ft/sec |
| cross sect. area of exhaust | 0.080 sq. ft. |
| cross sect. area of exhaust | 11.45 sq. in. |

The rate of ingestion of air was calculated for air at ambient temperature. In the above calculations, volume changes due to added fuel or the combustion process were assumed to be negligible.

The results indicate that the cross-sectional area of the exhaust gas stream produced by a 35-hp motor is 6.88 sq. in. at 30 mph and is 11.45 sq. in. at 18 mph. The values are the same regardless of whether a pump jet or propeller is mounted to the outboard motor.

A calculation of the portion of the exhaust stream causing drag for a typical 35-hp exhaust through the hub propeller outboard motor is presented in Table II.

TABLE II

Portion of Exhaust Stream Causing Drag for a Propeller Outboard Motor

| | |
|---|---|
| Propeller hub exit area | 8.81 sq. in. |

TABLE II-continued

Portion of Exhaust Stream Causing Drag for a Propeller Outboard Motor

| | |
|---|---|
| Cross sect. area of exhaust stream at 30 mph | 6.88 sq. in. |
| Portion of exhaust bubble creating added drag | −1.92 sq. in. |
| Cross sect. area of exhaust stream at 18 mph | 11.45 sq. in. |
| Portion of exhaust bubble creating added drag | 2.64 sq. in. |

The results indicate that when a boat operates at 30 mph no drag is added by the exhaust stream because the exhaust stream is 1.93 sq. in. smaller than the hub exit area and, thus, the exhaust stream is completely "in the shadow" of the area of the propeller hub. The exhaust stream does not contribute to drag since the exhaust stream fits into the area blocked by the propeller hub. When the boat operates at the slower speed of 18 mph, the exhaust stream has a wider cross sectional area which is 2.64 sq. in. larger than the area of the hub exit area. The larger area of the exhaust stream contributes somewhat to drag.

A similar calculation of drag area for a pump jet on the 35-hp outboard motor shown in FIG. 5 is illustrated in Table III.

TABLE III

Portion of Exhaust Stream Causing Drag for a Pump Jet With Exhaust Exiting at Squeeze Point

| | |
|---|---|
| Exit area at squeeze point | 3.00 sq. in. |
| Cross sect. area of exhaust stream at 30 mph boat speed | 6.88 sq. in. |
| Portion of exhaust bubble creating added drag | 3.88 sq. in. |
| Cross sect. area of exhaust stream at 18 mph boat speed | 11.45 sq. in. |
| Portion of exhaust bubble creating added drag | 8.45 sq. in. |

The results indicate a drag area of 3.88 sq. in. at 30 mph and 8.45 sq. in. at 18 mph. These drag areas are significantly greater than the drag areas for the propeller outboard.

The drag area for a 35-hp pump jet outboard motor shown in FIGS. 6 through 9 is estimated in Table IV.

TABLE IV

Portion of Exhaust Stream Causing Drag for a Pump Jet with Exhaust Exiting at Trough

| | |
|---|---|
| Trough exit area | 7.00 sq. in. |
| Cross sect. area of exhaust stream at 30 mph boat speed | 6.88 sq. in. |
| Portion of exhaust bubble creating added drag | −0.12 sq. in. |
| Cross sect. area of exhaust stream at 18 mph boat speed | 11.45 sq. in. |
| Portion of exhaust bubble creating added drag | 4.45 sq. in. |

The calculation of the drag area shows a significant reduction in the cross sectional area contributing to drag as compared to the pump jet without the trough. The drag for emerging exhaust gases for a boat travelling at 30 mph will be greatly improved since no additional cross sectional area of the exhaust stream contributes to drag. Further, the exhaust drag area for a boat travelling at 18 mph having a pump jet with a trough is 4.45 sq. in. This is only 53% of the drag area produced by a pump jet without a trough.

Table V is a comparison of the duct exit area and the hardware exit area for a pump jet without a trough and a pump jet with a trough.

TABLE V

| Duct Exit Area and Hardware Drag Areas Compared for Two Styles of Pump Jet | |
|---|---|
| Duct exit area, no trough | 3.00 sq. in. |
| Drag area of housing, no trough | 3.00 sq. in. |
| Duct exit area with trough | 7.00 sq. in. |
| Drag area of housing with trough | 3.75 sq. in. |
| Increase in duct exit area | 133 per cent |
| Increase in housing drag area | 25 per cent |
| Area in "shadow" of pump jet, no trough | 0 sq. in. |
| Area in "shadow", with trough | 3.25 sq. in. |

The "shadow" is defined as that portion of the flow that is downstream of the maximum diameter of the pump jet.

The results indicate that the area which is blocked by the diameter of the pump jet, referred to as the "shadow", is increased when a trough 48 is formed in the stator housing 60.

The present invention has the advantage of combining a pump jet with the discharge of exhaust gases through the central portion of an outboard motor body. The discharge of exhaust gas rearward of the squeeze point in an outboard motor with pump jet has the advantage of reduced drag of the motor. Further, the discharge of exhaust gases in trough formed in the stator housing has the advantage of expanding the exhaust stream behind the rotor housing without interfering with the jet stream 68 exiting the pump. Therefore, drag of the exhaust stream is partially or wholly canceled out by the drag of the rotor and stator housings. This permits the outboard motor to be operated at higher speeds with less power applied.

While the invention has been described with reference to the preferred embodiment thereof, it will be appreciated by those of ordinary skill in the art that modifications can be made to the structure and elements of the invention without departing from the spirit and scope of the invention as a whole.

I claim:

1. A marine apparatus for a motor having an attached pump jet comprising:

a stator housing positioned below the motor at the rear end thereof;

a trough located in the upper surface of said stator housing;

an exhaust duct extending downwardly and rearwardly from the motor towards the front end of said stator housing;

a rotor housing coupled forwardly and in axial alignment to said stator housing at the front end thereof said rotor housing has an upper surface and said exhaust duct is welded to said upper surface of said rotor housing;

an extension duct, said extension duct having one end coupled to the rear end of said exhaust duct and the other end located above said trough; and an anticavitation plate integral with said motor and forming the lower surface of said motor, wherein the width of the forward end of said stator housing which is coupled to said rotor housing is wider than the rear end of said stator housing, whereby the flow of water around said pump is squeezed between the point where said stator housing is coupled to said rotor housing and the lower surface of said anticavitation plate at a squeeze point and said extension duct is located rearwardly of said squeeze point; wherein exhaust from the motor is discharged into said exhaust duct and exists the jet pump from said extension duct.

2. The apparatus according to claim 1 wherein the end of said extension duct located above said trough flares outwardly.

3. The apparatus according to claim 1 wherein said extension duct is attached to said exhaust duct with screws and said extension duct is attached to the lower surface of said upper pump housing with screws.

4. The apparatus according to claim 1 wherein said extension duct is formed of sheet metal.

5. The apparatus according to claim 1 wherein said extension duct is formed of an aluminum die casting.

6. The apparatus according to claim 1 wherein said extension duct is formed of injection-molded plastic.

7. The apparatus according to claim 1 wherein said motor includes a lower unit and said rotor housing is attached to said lower unit with at least one strut.

8. The apparatus according to claim 7 wherein said lower unit, rotor housing, exhaust duct, and at least one strut are formed by single integrated casting.

9. A marine apparatus for a motor having an attached pump jet, said motor including an anticavitation plate, said apparatus comprising:

a stator housing positioned below said anticavitation plate;

a rotor housing, said rotor housing having a larger diameter at its rear end than at its front end and said stator housing having a larger diameter at its front end than at its rear end, said rotor housing being coupled at a position in axial alignment to said stator housing at said larger diameter of said rotor housing and said larger diameter of said stator housing;

an exhaust duct extending vertically downwardly through the central portion of said motor; and an extension duct coupled to said exhaust duct extending rearwardly from said motor between said anticavitation plate and said stator housing;

wherein the flow of water around said pump is squeezed between said position where said rotor housing and said stator housing are coupled and said anticavitation plate to form a squeeze point and said extension duct extends to said squeeze point and said extension duct extends to said squeeze point so that exhaust gas is discharged at said squeeze point.

* * * * *